US007776187B2

(12) United States Patent
Spence et al.

(10) Patent No.: US 7,776,187 B2
(45) Date of Patent: Aug. 17, 2010

(54) BELT HAVING A NON-LINEAR SEAM AND A METHOD OF ON-MACHINE JOINING OF BELT ENDS

(75) Inventors: Michael Spence, Blackburn (GB); Paul Riding, Blackburn (GB); John Jeffrey, Blackburn (GB)

(73) Assignee: Voith Patent GmbH, Heidenheim (DE)

( * ) Notice: Subject to any disclaimer, the term of this patent is extended or adjusted under 35 U.S.C. 154(b) by 532 days.

(21) Appl. No.: 11/690,331

(22) Filed: Mar. 23, 2007

(65) Prior Publication Data

US 2008/0230198 A1 Sep. 25, 2008

(51) Int. Cl.
*D21F 7/10* (2006.01)

(52) U.S. Cl. ..... 162/358.4; 162/901; 162/904; 428/58; 24/31 F

(58) Field of Classification Search ..... 162/348, 162/358.2, 900–904, 306, 358.4; 428/57, 428/58, 61; 24/38, 31 B, 31 F, 31 L; 28/141, 28/142; 139/383 AA; 198/844.2; 474/253, 474/255, 256

See application file for complete search history.

(56) References Cited

U.S. PATENT DOCUMENTS

| | | | | |
|---|---|---|---|---|
| 2,005,979 | A * | 6/1935 | Milnes | 24/33 B |
| 3,309,790 | A * | 3/1967 | MacBean | 34/659 |
| 3,323,226 | A * | 6/1967 | Beaumont et al. | 34/95 |
| 3,324,991 | A * | 6/1967 | Voss | 198/844.2 |
| 4,345,730 | A | 8/1982 | Leuvelink | |
| 4,842,905 | A * | 6/1989 | Stech | 428/33 |
| 4,911,683 | A * | 3/1990 | Legge et al. | 474/255 |
| 5,169,570 | A | 12/1992 | Sayers et al. | |
| 5,419,017 | A | 5/1995 | Buchanan et al. | |
| 5,601,877 | A | 2/1997 | Miller et al. | |
| 5,707,496 | A * | 1/1998 | Johnson et al. | 162/348 |
| 5,724,706 | A * | 3/1998 | Jakob | 24/38 |
| 5,789,052 | A | 8/1998 | Miller et al. | |
| 6,328,079 | B1 * | 12/2001 | Zils | 139/383 AA |
| 6,544,389 | B2 * | 4/2003 | Johnson | 162/348 |
| 6,569,290 | B2 * | 5/2003 | Johnson | 162/348 |
| 6,811,849 | B2 * | 11/2004 | Best | 428/58 |
| 7,005,041 | B2 | 2/2006 | Best | |
| 7,381,306 | B2 * | 6/2008 | Best et al. | 162/348 |
| 2004/0033856 | A1 | 2/2004 | Levine | |
| 2005/0095414 | A1 | 5/2005 | Maguire et al. | |
| 2008/0295306 | A1 * | 12/2008 | Despault | 28/142 |

FOREIGN PATENT DOCUMENTS

DE 4313356 A1 * 10/1994

(Continued)

*Primary Examiner*—Eric Hug
(74) *Attorney, Agent, or Firm*—Greenblum & Bernstein, P.L.C.

(57) ABSTRACT

An industrial belt having a non-linear seam adapted to be on-machine joinable. In a particular embodiment, the seam is made up of a opposite end regions of the belt having complementary projections, such as in the form of castellations, which engage at the seam, providing a completely integrated belt throughout the zone of the seam. In the field of papermaking, the belt of the invention can take the form of a transfer belt, whereby the invention provides a fully interlocking, strong seam which minimizes any potential mechanical or hydraulic sheet marking. The invention also includes a method of creating the end regions of the belt, seaming the belt, and casting the belt.

15 Claims, 9 Drawing Sheets

FOREIGN PATENT DOCUMENTS

| | | | |
|---|---|---|---|
| EP | 0399674 | | 11/1990 |
| EP | 0518494 | | 12/1992 |
| EP | 0695827 | | 2/1996 |
| EP | 1241378 | | 9/2002 |
| EP | 1357224 | | 10/2003 |
| FR | 929951 A | * | 1/1948 |
| GB | 2346387 | | 8/2000 |
| JP | 05-008226 | * | 1/1993 |
| WO | 93/17161 | | 9/1993 |
| WO | 2004/016969 | | 2/2004 |

* cited by examiner

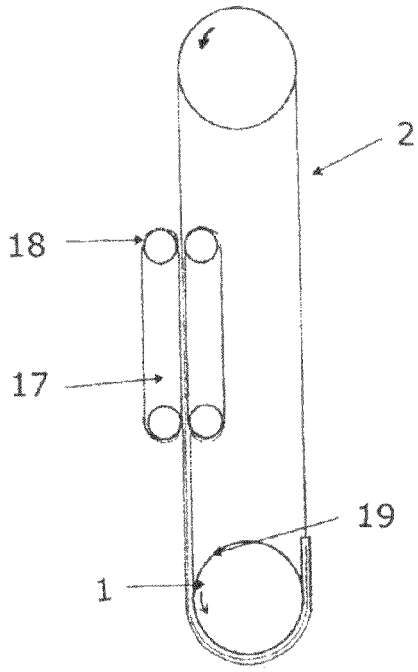
FIG. 9
FIG. 10
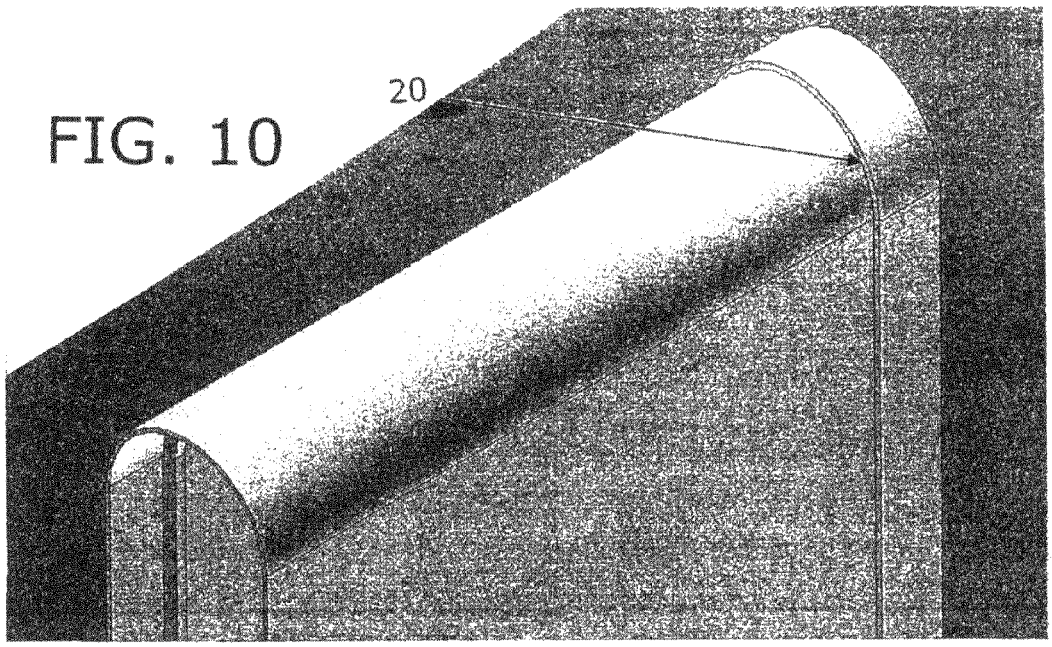

BELT HAVING A NON-LINEAR SEAM AND A METHOD OF ON-MACHINE JOINING OF BELT ENDS

BACKGROUND OF THE INVENTION

1. Field of the Invention

The present invention relates generally to industrial belts, particularly belts for use in papermaking machines, as well as to a method of making a seam and on-machine joining of the opposite ends of a non-endless belt at the seam, the seam thus created resulting in minimal sheet marking during use.

2. Discussion of Background Information

Industrial belt products, as well as methods of installation thereof, have long been limited by a failure to have available, particularly in the field of papermaking machinery, a successful and practical way to join the opposite ends of a belt during installation of the belt while on the machine.

Prior art attempts to devise products and methods for joining the ends of non-endless belts, while on the machine, are inspired by certain advantages inherent in same, such as that of reducing downtime for the machine. Despite such attempts, however, a successful, practical, belt structure and method of installation thereof have yet to appear in the marketplace.

Belts used in papermaking machines can be made as a conventional woven fabric or have a nonwoven structure, which structure can be at least partially encapsulated in a polymer matrix.

Woven fabrics for endless belts for papermaking machines can be manufactured by one of two basic weaving techniques. In the first technique, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available which, for certain fabrics, may be used to automate at least part of the joining process. In a flat woven papermaker's fabric, the warp yarns extend in the machine direction (MD) and the filling yarns extend in the cross machine direction (CD). In the second basic weaving technique, fabrics are woven directly in the form of a continuous belt with an endless weaving process. In the endless weaving process, the warp yarns extend in the cross machine direction and the filling yarns extend in the machine direction. Both of these weaving methods for endless belts in the art of papermaking machinery are well-known.

A papermaking belt having a nonwoven structure is disclosed in the patent document GB 2346387 (Jeffrey et al.). More particularly, GB '387 discloses a plurality of embodiments of a transfer fabric for use in papermaking machines and, more particularly, in a tissue making machine. In one particular embodiment, the fabric has a nonwoven internal reinforcing structure that includes a spiral link fabric having interdigitated spiral loops providing machine direction (MD) extending members and cross machine-direction (CD) yarns providing pintles or binding yarns which join the spirals together. The fabric Is fully impregnated with a polymer, such as polyurethane, which covers both faces of the fabric. The yarns forming both the spirals and the binding yarns can be made of a polyester, such as PET, for example. The transfer fabric is disclosed as having the following exemplary dimensions: 3-7 millimeters thick, 1-50 meters long, and up to 5 meters wide. Further, the fabric is disclosed as having a flexibility sufficient to allow for high roll wrap angles and capable of withstanding loads up to 600 pli.

Further, GB '387 discloses that the fabric can be either endless or provided with a seam, such as a seam disclosed in EP 0518494 (Buchanan et al.). If the fabric is provided with a seam, it is disclosed that such seam must have the ability to pass through a soft or hard calender nip without marking the web or disturbing the dynamics of the nip.

The referenced document EP '494 is based upon an earlier disclosure in EP 0399674 (Sayers et al.) and family member U.S. Pat. No. 5,169,570. The invention of EP '674 and US '570 relates to the joining together of opposite ends of an industrial fabric at a seam for forming an endless belt, particularly a belt for use in papermaking machines. Disclosed therein are prior attempts to provide a belt seam from seam-forming elements at the ends of a papermakers' fabric, whereby the ends are securely and uniformly joined in such manner that the permeability in the area of the seam is not materially different from that of the body of the fabric. More specifically, the invention of EP '674 and US '570 is the provision of loops or loop-like structures at a fabric end, either a woven construction or otherwise, for cooperation with a complementary formation at the opposite end of the fabric, through which loops or loop-like structures pintle wires are received.

The invention of EP '674 and US '570, although formed with loops or loop-like end structures, provides no intercogitation of the opposing elements. They merely act to present the loops/loop-like end structures in a width-wise orientation for simplifying the seaming.

The aforementioned EP '494 and family member U.S. Pat. No. 5,419,017 disclose an alternative to the invention of EP '674 and US '570, whereby an external temporary bridge is used to hook over the tops of the opposite ends of a belt which are joined by interdigitated loops engaged with a pintle wire to form the hinged seam. For securing the bridge to the ends of the belt, each end of the bridge is provided with a plurality of pegs, the pegs being complementary with apertures provided in the ends of the belt. After the two ends of the belt are seamed together, the bridge is removed.

The document WO 93/17161 (Lidar) discloses a seam for a textile belt in which joining eyelets extend from the edges of the respective ends of the belt, i.e., beyond the ends of the polymer coating of the belt, so that a flap is required to be inserted over the area of the joining eyelets to prevent marking of the sheet. The seaming technique disclosed is time-consuming and awkward and not suitable for commercialization. Further, particularly in view of the need for the seam-covering flap, it is not suitable for a rigid, or substantially rigid, fully-encased belt.

To limit sheet marking, the document EP 06958827 (Miller et al.), and family members U.S. Pat. Nos. 5,601,877 and 5,789,052, disclose a construction similar to that of WO '161, whereby an encapsulating material is added in the seam area on the reverse side of the belt fabric. Despite the improvement, the resulting belt is fundamentally a belt having a one-sided coating with a relatively flexible characteristic, in contrast to a belt, e.g., which is a rigid, or substantially rigid, fully-encased belt.

More recently, the document EP 1241378 (Takeuchi et al.) discloses the insertion of a respective independent seam element into each of the edges of the cut fabric of the belt. The use of such elements increase costs, adds a layer of complexity to the structure of the belt, and adds time-consuming steps to the, seaming of the belt, thereby risking increased downtime for installation and repairs of the affected-machinery.

An approach similar to that of EP '378 is disclosed in the document EP 1357224 (Best), and in family member U.S. Pat. No. 7,005,041, whereby "insertion connections" are used to connect coupling elements to the MD yarns. As with the EP '378 concept, that of EP '224 relies upon elements that are additional to the initial belt structure which elements increase costs, adds complexity and time-consuming steps to the seaming of the belt.

The document WO 2004/016969 (Levine) and family member US 2004/0033856 disclose an industrial belt, such as for used in a bowling alley pinspotter machine. The belt includes spiral links, which are overlapped in the machine direction, and pintles which extend through the overlapping portions of the internal spaces of the links to join the links to form a continuous material. The spiral links can be made of metal or polymer, such as polyester and polyamide, which are coated with a material having a high elasticity/impact resistance, such as a silicone rubber elastomer, preferably keeping the belt relatively thin and flexible to provide easier maneuverability when the belt is removed by a technician. In this regard, the coating is preferred to extend beyond the top surface of the spiral links by 0.010-0.250 inches or more. A surface of the coating is cut and then springs back to expose a sufficient amount of the spiral links on both sides of the seam to allow refitting onto the machine using an appropriate pintle wire. The seam thus made would not be satisfactory for certain applications, such as for papermaking machinery, since there would be a significant CD wide gap and sheet marking would result.

Despite the disclosures of the aforementioned patent documents, the need remains, particularly in the field of papermaking machinery, for a non-endless belt which is on-the-machine seamable, providing an easier and less time-consuming installation, and one which results in minimal sheet marking during use.

SUMMARY OF THE INVENTION

The present invention relates to an on-machine seamable industrial belt that includes an encapsulated base structure, the base structure including a plurality of machine-direction (MD) extending members a plurality of cross-machine-direction (CD) extending members interconnected with the MD-extending members, the encapsulated base structure having first and second complementary inter-connectable end regions forming a non-linear seam. Each of the end regions includes a plurality of CD-spaced-apart, MD-extending projections, within each of which are a plurality of parallel CD-extending tubular pathways which are adapted to receive a CD-extending member.

By the connection of the two end regions of the non-endless belt by means of the non-linear seam, the belt is made endless. In this regard, the seam is made by means of the plurality of CD-extending members received within the tubular pathways and extending from a first side to a second side of the belt. In the zone of the non-linear seam, the initial structure of the belt remains, thereby providing a fully integrated strong seam which minimizes sheet marking.

The belt, when connected on the machine, lies flat throughout its working surface between successive guide rollers in the machine direction, including through the seam, so as to minimize sheet marking.

The base structure of the belt of the invention can be either a woven or a nonwoven structure.

In a particular embodiment, a nonwoven base structure can take the form of a spiral link structure that includes a plurality of CD-extending rows of interdigitated spiral loops, each of the loops constituting a MD-extending member, the spiral link structure further including a series of CD-extending pintles.

A particular feature of the belt made according to the invention is that when the end regions of the belt are connected at the seam, the first and second end regions form a continuous non-linear seam from a first side to a second side of the belt, i.e., no gap or no significant gap is present in the seam, thereby providing a fully interlocking, strong seam which minimizes sheet marking.

In a particular embodiment of a belt according to the invention, the plurality of CD-spaced-apart MD-extending projections of the first and second end regions are in the form of a plurality of castellations, whereby the castellations of the first end region mesh with the castellations of the second end region at the non-linear seam.

In the castellated embodiment, a plurality of the CD-extending members are received within the tubular pathways within each of the castellations and extending from a first side to a second side of the endless belt.

A particular embodiment of a belt manufactured according to the invention includes an encapsulated nonwoven spiral link base structure that includes a plurality of rows of interdigitated spiral loops, each of the rows extending in the cross machine direction, each of the loops constituting a machine-direction extending member, the base structure also including a series of CD-extending parallel pintles, each of the pintles interconnecting a respective one of the plurality of rows of loops, the encapsulated spiral link structure having first and second complementary inter-connectable end regions forming a non-linear seam, with each of the end regions comprising a plurality of CD-spaced-apart, MD-extending projections, each of which projections has a plurality of parallel CD-extending tubular pathways, each of the tubular pathways adapted to receive a -pintle. In a particular embodiment, the projections take the form of a castellation.

The invention also includes a method of constructing the seam, including the end regions, and joining the end regions to form an endless belt.

More particularly, such method includes, prior to adding the layer of impregnating material to the base structure, designating an area along a length of the base structure as an area for the seam; inserting tubular pintles within the base structure from one side of the base structure to a second side; inserting seaming pintles within respective ones of the tubular pintles; adding the layer of impregnated material to form the encapsulated base structure; cutting the seam in the designated area through a thickness of the encapsulated base structure, including cutting the tubular pintles and the seaming pintles; and removing the tubular pintles and the seaming pintles from the encapsulated base structure, thereby leaving the plurality of tubular pathways within the projections.

When desired to join the ends of the thusly formed non-endless belt on the machine to which it is to be used, the method of forming the belt into an endless belt on the machine further includes re-making the seam previously created by adding CD-extending pintles within the tubular pathways from one side of the belt to a second side.

BRIEF DESCRIPTION OF THE DRAWING

The invention is further described in the detailed description which follows, with reference to the accompanying drawings which illustrate a non-limiting exemplary embodiment of the invention, in which like reference numerals represent similar parts throughout the several views of the drawings, and wherein:

FIG. 9 is a schematic depiction of a process by which a belt, seamed according to the invention, is cast with a polymer coating; and FIG. 10 illustrates a fragmentary perspective view of a casting belt used in the process depicted in FIG. 9.

DETAILED DESCRIPTION OF THE INVENTION

The particulars shown in the accompanying drawings and described herein are presented by way of example and for the purpose of providing an illustrative discussion of the invention only, providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the invention can be embodied in practice.

The invention described hereafter relates to a seam for a belt, such as a transfer belt, for example, of a papermaking machine. Such belt is commonly referred to as a transfer fabric. Reference can be had to the aforementioned GB 2346387 (Jeffrey et al.), the disclosure of which is hereby incorporated by reference thereto in its entirety, for the disclosure of the structure of such a belt/fabric to which the invention can be applied.

Figure 1:
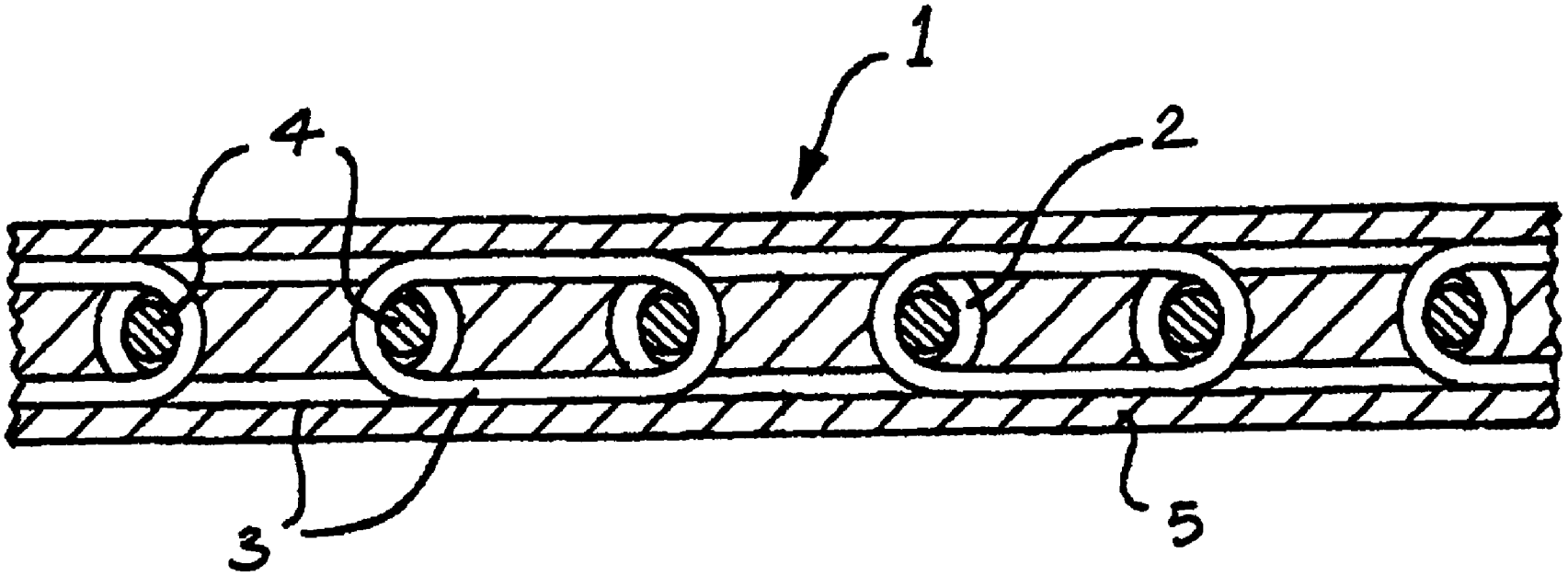
FIG. 1 illustrates a fragmentary cross section of a belt to which a seam according to the invention can be applied, or which the invention incorporates.

FIG. 1 illustrates a fragmentary cross section of such a belt to which the invention can be applied, or which the invention incorporates. Although the belt has a nonwoven structure, the invention encompasses a woven belt/fabric as well.

As shown in FIG. 1, the belt 1 has a spiral link structure 2, or base, that includes interdigitated spiral loops 3, which provide machine-direction (MD) extending members. The spiral link structure/base also includes cross machine-direction (CD) yarns 4, providing pintles or binding yarns which join the spirals 3 together. The spiral link structure 2 can be similar to that disclosed in U.S. Pat. No. 4,345,730 (Leuvelink), the disclosure of which is hereby incorporated by reference thereto in its entirety. The spiral link structure of the belt 1 shown in FIG. 1 is further impregnated with a polymer 5, the layer of polymer being sufficiently thick to cover the spiral link structure.

As mentioned above, the invention is directed to a structure and method of forming a seam in a belt/fabric like that of FIG. 1. More particularly, the invention is directed to a loop and pintle joining system which creates a fully interlocking, strong seam which minimizes any potential mechanical or hydraulic sheet marking, as explained further herein. In contrast to the invention, if a conventional type seam were to be used on a belt, once the belt is installed on a papermaking machine, e.g., and a running tension were to be applied, the belt would open up a significant gap on the surface. Such a gap would undoubtedly cause a mechanical mark on the paper sheet and could, in a worst case, cause sheet breaks.

Figure 2:
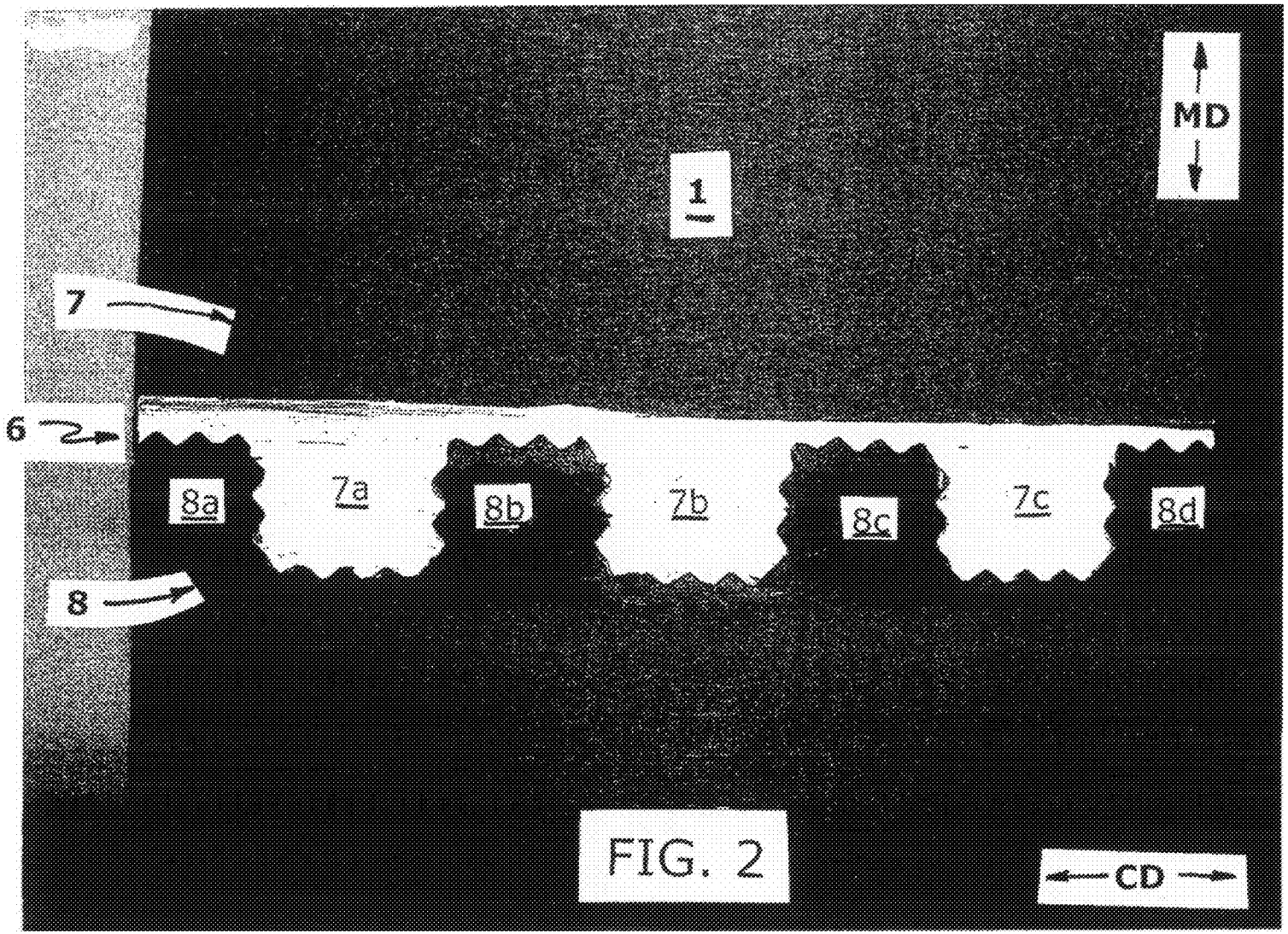
FIG. 2 illustrates a fragmentary enlarged top view of the belt, which shows the seam according to the invention.

FIG. 2 illustrates a plan view of the belt 1 in the area of a seam 6. The seam 6 is created between the end regions 7 and 8 of the belt. In the particular exemplary embodiment of the seam shown in the drawing, each of the end regions of the belt includes a plurality of projections formed in the plane of the belt. More particularly, the end region 7 includes projections 7*a*, 7*b*, and 7*c*, or flap interlocks, which extend in the machine direction and which are mutually spaced apart in the cross machine direction. Likewise, the end region 8 includes projections 8*a*, 8*b*, 8*c*, and 8*d*.

Figure 3:
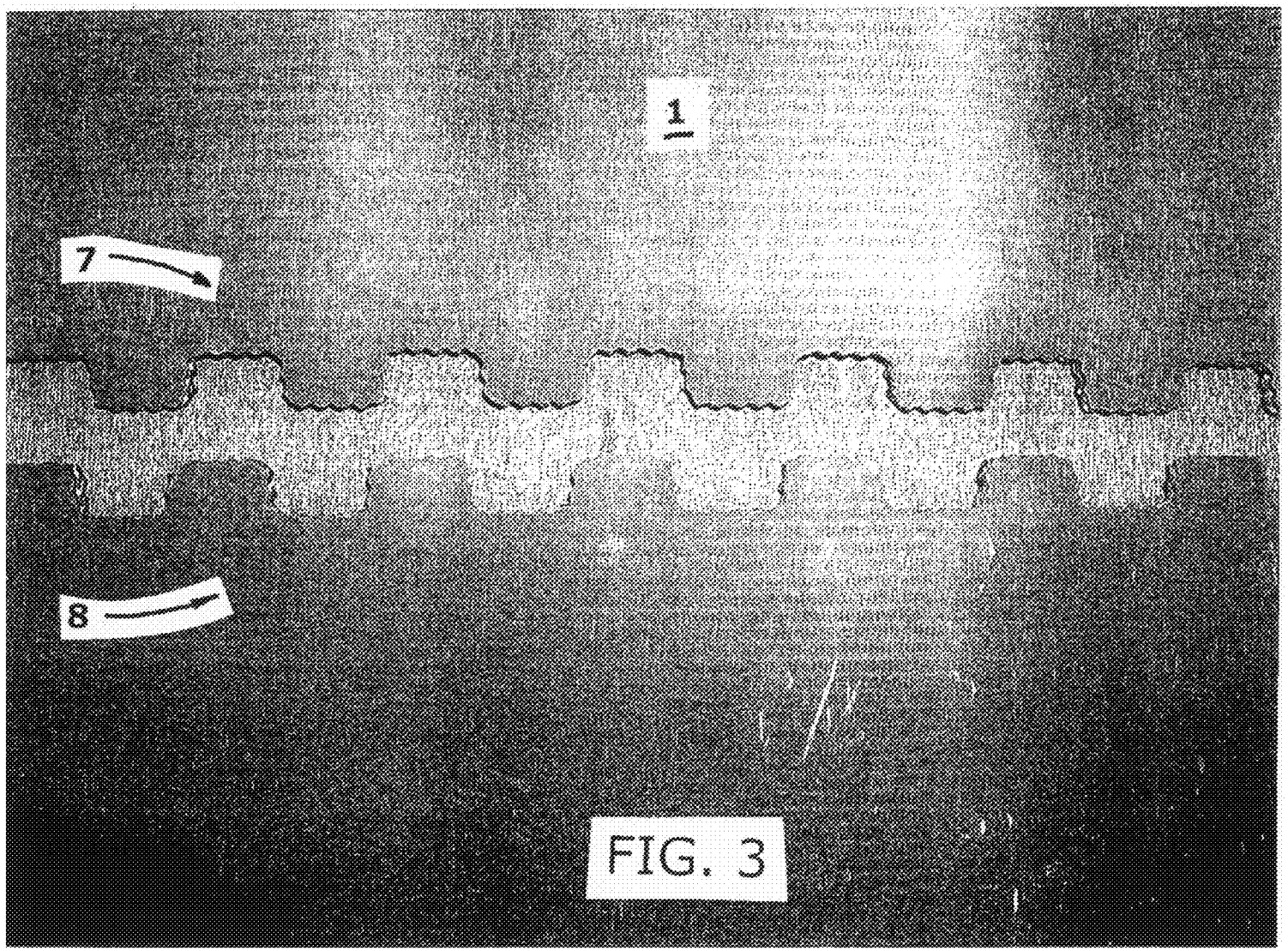
FIG. 3 illustrates a fragmentary non-enlarged top view of the belt, showing the end regions of the belt prior to seam formation.

FIG. 3, which, like FIG. 2, illustrates a fragmentary top view of the belt 1, shows the end regions 7, 8 of the belt prior to engagement of the projections 7*a*-7*c* with the projections 8*a*-8*d*. Both FIGS. 2 and 3 are fragmentary views, whereby the length of the belt in the machine direction (MD) and the width of the belt in the cross machine direction (CD) can be made to any particular dimensions according to the application. As one non-limiting example, the belt can have a length of 15 meters and a width of 4.5 meters. The number of projections 7*a*, 7*b*, etc. and 8*a*, 8*b*, etc. for the end regions 7, 8 can also vary depending upon the particular application. In the aforementioned non-limiting example, each end region can have projections in the range of 90 millimeters to 225 millimeters.

In FIG. 2, each of the projections 7*a*-7*c*, 8*a*-8*d* is shown to be generally rectangular in form, whereby each of the end regions 7, 8 of the belt 1 has a castellated shape, formed by CD-extending spaced-apart castellations. This shape is not limiting, whereby the projections could be formed in any of a variety of shapes, such as triangular, arcuate, for example.

In any event, the peripheral surfaces of the projections 7*a*-7*c*, as shown in FIG. 2, fully interlock, or mesh, with the peripheral surfaces of the projections 8*a*-8*d*, leaving no gap, or no appreciable gap, in the seam, i.e., between the end surfaces of the end regions 7, 8, i.e., the seam 6 extends continuously from one side of the belt to the other side of the belt in the cross machine direction.

Further, in the exemplary embodiment shown in FIG. 2, the peripheries of the projections, i.e., the peripheries of the castellations of each of the end regions 7, 8, have serrations. More particularly, such serrations 9 of the projections are generally sawtooth in shape and collectively extend from one side of the belt to the other in forming the aforementioned continuous seam. The serrations are used in this embodiment, i.e., an embodiment in which the projections are formed as rectangular castellations, with opposite edges of such castellations extending in the machine direction (MD), so as to provide the necessary locking mechanism whereby, when the belt is under tension, no gap appears between adjoining members.

In one particular alternative embodiment, however, rather than rectangular, the projections could be keyhole-shaped, with the leading edges of each of the interlocked sections of the belt having the broader portions of the keyhole-shaped projections being restrained from separating in the machine direction because of the narrower portion of the respective opposing recesses, i.e., the broader ends of the keyhole-shaped projections would not pass back through the neck ends and, therefore, preventing the formation of a gap when the belt is under tension. In this alternative embodiment, serrations are not necessary inasmuch as the keyhole shapes oppose the formation of a gap. On the other hand, fitting the ends of the belt together at the seam is more difficult with an embodiment such as the keyhole-shaped embodiment because the projections must be lifted and placed in position, since the ends of the belt cannot be simply slid in place "in-plane." With the serrated-castellation embodiment, although the serrations might provide some resistance to sliding together in-plane, the relatively small dimension of the serrations allow the slight resilience of the projections transversely to allow such sliding and fitting together of the ends of the belt.

A particular advantage that is realized by the aforementioned serrations, particularly the serrations that extend in the machine direction, is that they ensure that even when the belt 1 is tensioned, no gap—or no significant gap—is created in the seam 6. That is, the meshing of the serrations 9 along the seam assist in taking up the tension force applied to the belt through the area of the seam.

Figure 4:
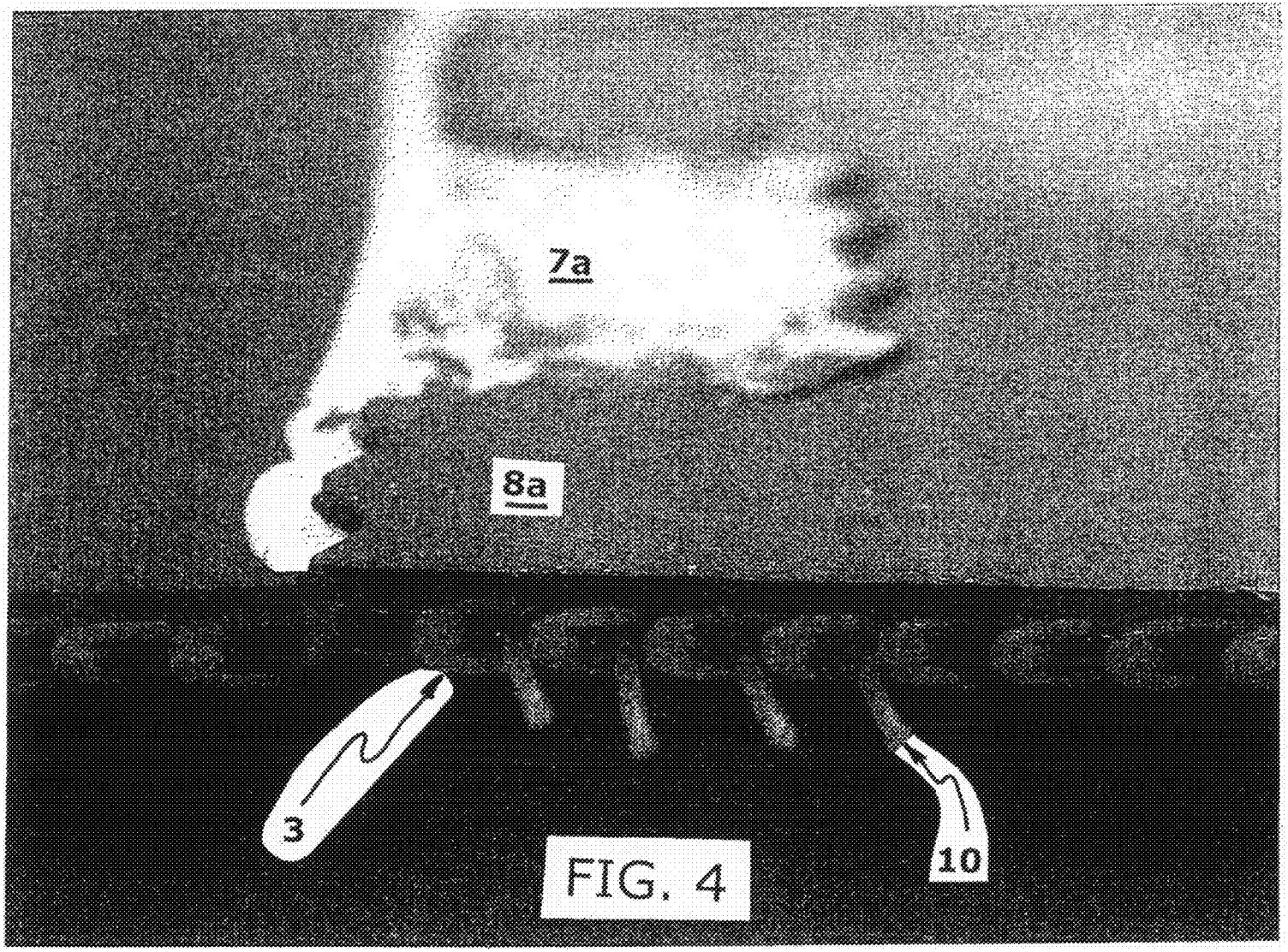
FIG. 4 illustrates, in a side perspective view, the seamed belt during construction of the seam with steel wires protruding in the cross machine direction from the ends of the projections of the end regions of the belt.

However, as can be understood in conjunction with FIG. 4, and as further explained below, because the integrity of the base structure of the belt is maintained throughout the seaming zone 6, the strength of the belt is maintained throughout its length, including in the seaming zone. That is, as shown in FIG. 4, throughout the width of the castellations 8*a* and 7*a* there are four interdigitated rows of spiral loops 3 extending in the cross machine direction. Successive rows of spiral loops are shown in FIG. 4 to extend not only through the MD-length of the castellations, but throughout the length of the belt, as explained above in connection with FIG. 1. That is, rather than relying upon additional coupling elements in the area of the seam 6 to provide tension strength for the seam, the invention relies upon the structure of the belt itself in the zone of the seam.

Figure 5:
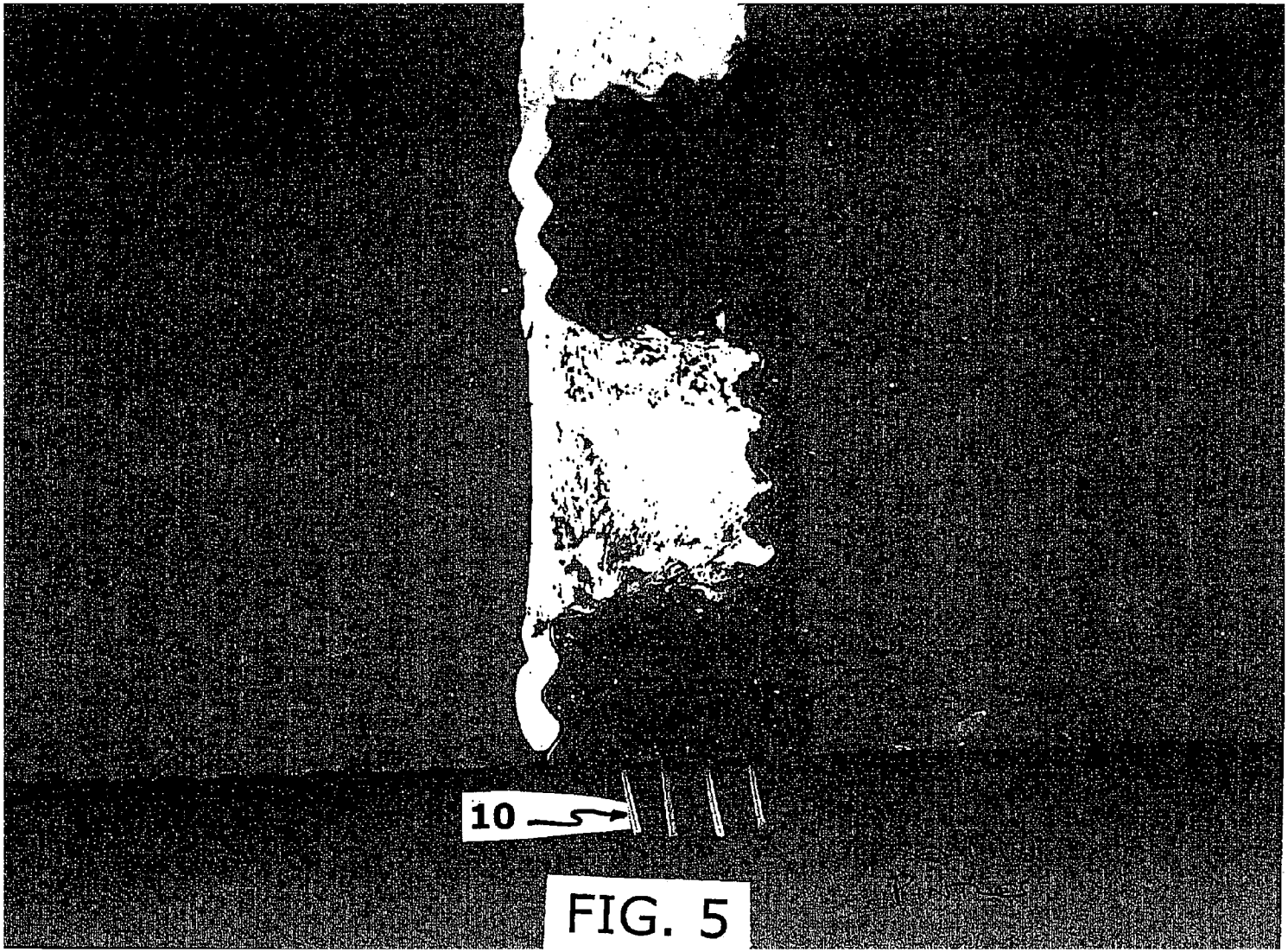
FIG. 5 illustrates the seamed belt shown in FIG. 4, in a plan view.

Not only does the feature of the invention whereby additional coupling elements are not relied upon in the area of the seam maintain the integrity of the belt through the zone of the seam, the belt can be maintained flat through its length, including the area of the seam, as shown in the top view of FIG. 5. That is, although the seam would tend to open as it is guided around a roll, its working length between successive rolls will be maintained flat. This feature is enhanced by the provision of a plurality of rows of interdigitated loops 3 and associated pintles in the seam, i.e., four as shown in FIG. 4. More particularly, if only a single row of loops were to extend the length of the seam, the seam would create a mere hinge. The use of two or more rows, and associated pintles, however, ensures that the seam—comprised of the aforementioned meshed projections 7*a*-7*c*, etc., 8*a*-8*d*, etc.—tends to remain as flat as possible, even as the seam goes around rolls.

FIGS. 4-7 illustrate the seamed belt during construction of the seam, with steel wires 10 protruding in the cross machine direction from the ends of the. projections 8*a* and 8*f* of the end region 8 of the belt. The steel wires are seaming pintles, as will be further described below. Upon completion of the seam 6, in the place of the seaming pintles 10, pintle wires are inserted, made of polyester mono or steel, for example, each of which extends through an entire row of interdigitated loops 3. Such pintle wires maintain the integrity of the base structure of the belt that was maintained by the CD yarns/pintles 4, shown in FIG. 1.

The method of constructing the seam will next be described with reference to FIGS. 4-8.

Figure 6:
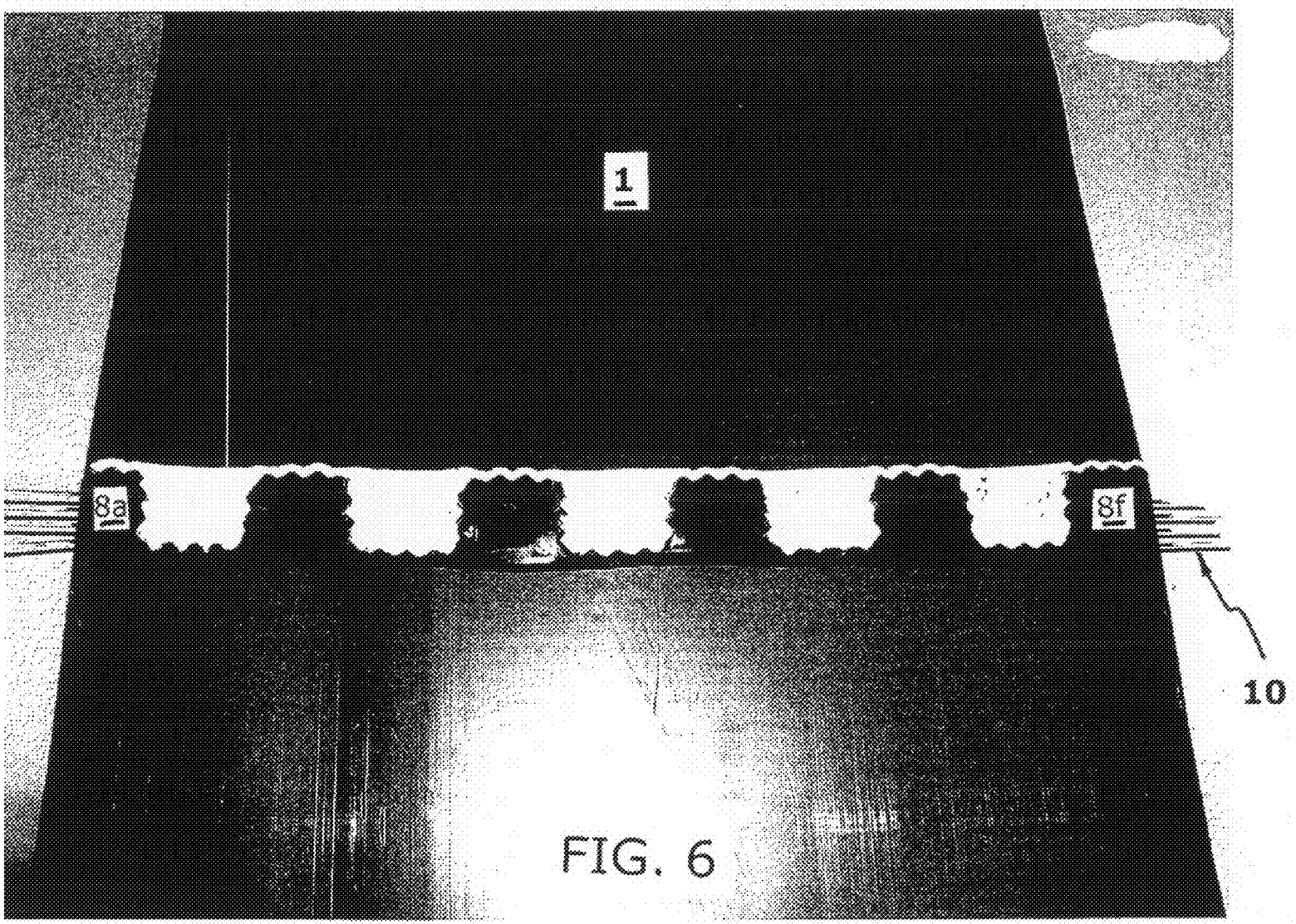
FIG. 6 illustrates the seamed belt of FIGS. 4 and 5, in a perspective view taken in the machine direction.
Figure 7:
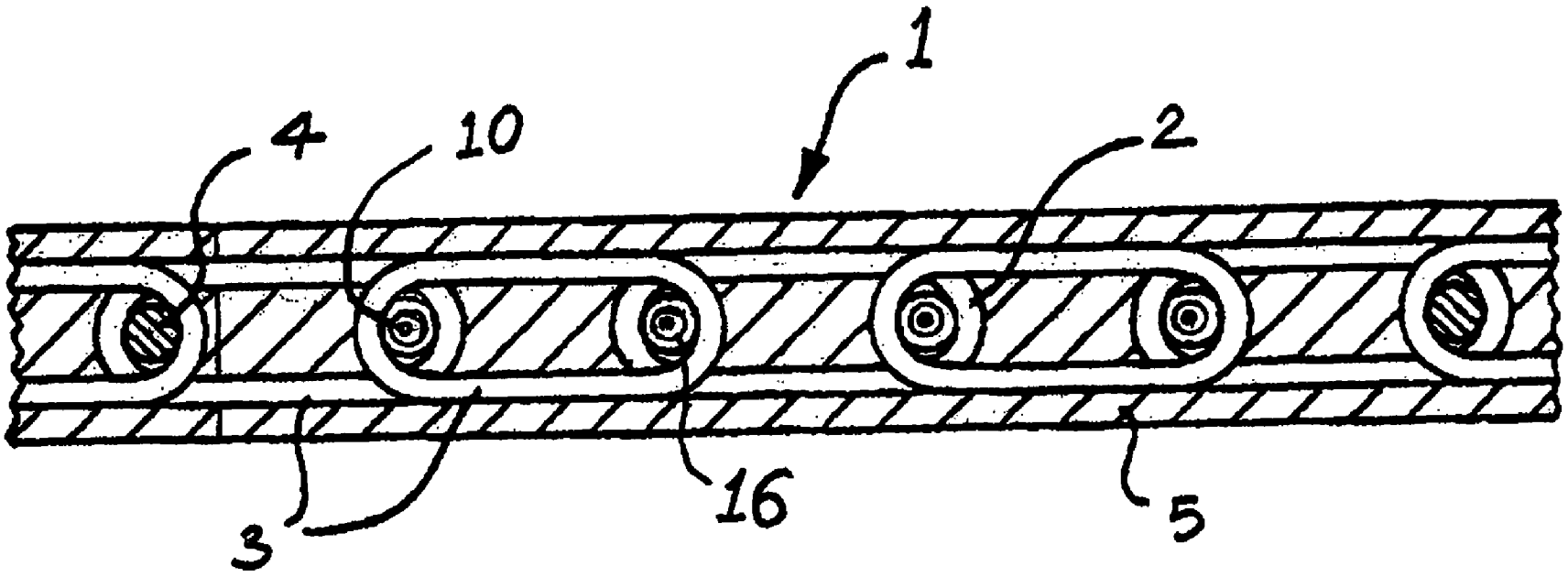
FIG. 7 illustrates a fragmentary cross section of a belt, like that of FIG. 1, which shows tubular pintles in the area of the seam.

First, before the seam is cut, the fabric is seamed up on a suitable machine, known to those skilled in the art, in readiness for casting. That is, the base structure of the belt, i.e., the loops 3 and pintles 4, is prepared for having the encapsulating layer, such as polymer layer 5, added. More particularly, prior to the creation of a seam, the fabric being readied has an endless form. An area of the endless fabric is designated for the seam. In this area, the available gaps within the loops in the rows of interdigitated loops 3 are filled with silicone rubber additional tubular pintles 16, as shown in FIG. 7. A sufficient number of such pintles are inserted to cover the depth (in MD) of the castellations chosen for the seam. In the embodiment shown in FIGS. 4-7, four tubular pintles are inserted. A purpose of the tubular pintles is to prevent the cast polymer from attaching itself to the pintle wires 10, which are used to seam up the fabric when it is installed on the papermaking machine. Therefore, other materials, such as a flouropolymer, PTFE, e.g., could be used for the tubular pintles in an alternative embodiment.

Once all of the tubular pintles are in place, lengths of seaming pintles 10, such as lengths of steel wire, are inserted through respective ones of the tubular pintles. FIG. 6 shows the steel seaming wires protruding from either side of the seam. The seaming pintles 10 serve a dual purpose. First, they stop the tubular pintles from collapsing during casting. Second, they enable a sensor to be used to locate/mark the position of the seam across the fabric.

Next, the fabric thus prepared is cast, i.e., the polymer coating 5 (see FIG. 1) is added and the belt is subjected to a grinding operation, as needed.

A suitable process by which the spiral link base fabric 2 is cast is schematically illustrated in FIG. 9. Unlike known casting processes of PU belts, which provide for a horizontal extrusion onto the surface of a base substrate (through nozzles or with a blade coating, for example), the invention utilizes a vertical application of polymer to the spiral link base fabric 2 by means of a pair of opposed casting belts 17, which can be of FEP (fluorinated ethylene propylene), for example. Polymer (PU, e.g.) is fed onto one side 18 of the base fabric, the fed polymer then travels through the fabric 2 to create a monocoque structure in the finished cast belt 1. Both cells traverse across the fabric, which means the polymer is spirally cast onto the base fabric. Spiral applications of polymer onto a substrate are known, although the system and process of the invention relies upon the vertical application of polymer. FIG. 10 illustrates that the height 20 of the casting wall of the casting belts governs the polymer thickness on both sides of the base fabric 2. At point 19 beneath the casting belts, the polymer is in a cheesy state, prior to hardening into the finished cast belt.

Benefits of such vertical application of polymer include no air entrapment. In addition, the polymer is controlled on both sides of the base fabric simultaneously. Further, the belts 17 are changed and act as grinding media to adjust the finish on one or both sides of the belt.

Benefits of the end product produced by the process depicted in FIGS. 9 and 10 include a high quality homogenous surface, with no delamination problems, good abrasion resistance, and a belt that is dimensionally stable under tension. In addition, the process provides for very good repeatability from belt to belt thus manufactured.

The grinding aspect of the process also has strengths according to the invention. In particular, the surface finish is easily modified by varying the speed of the base fabric belt, that of the abrasive belt or the cell traverse, as well as varying the abrasive.

After completion of casting and grinding, the belt is removed from the machine. Then, using a sensor to track the location of the seaming pintles 10, the seam is marked in readiness for cutting.

Figure 8:
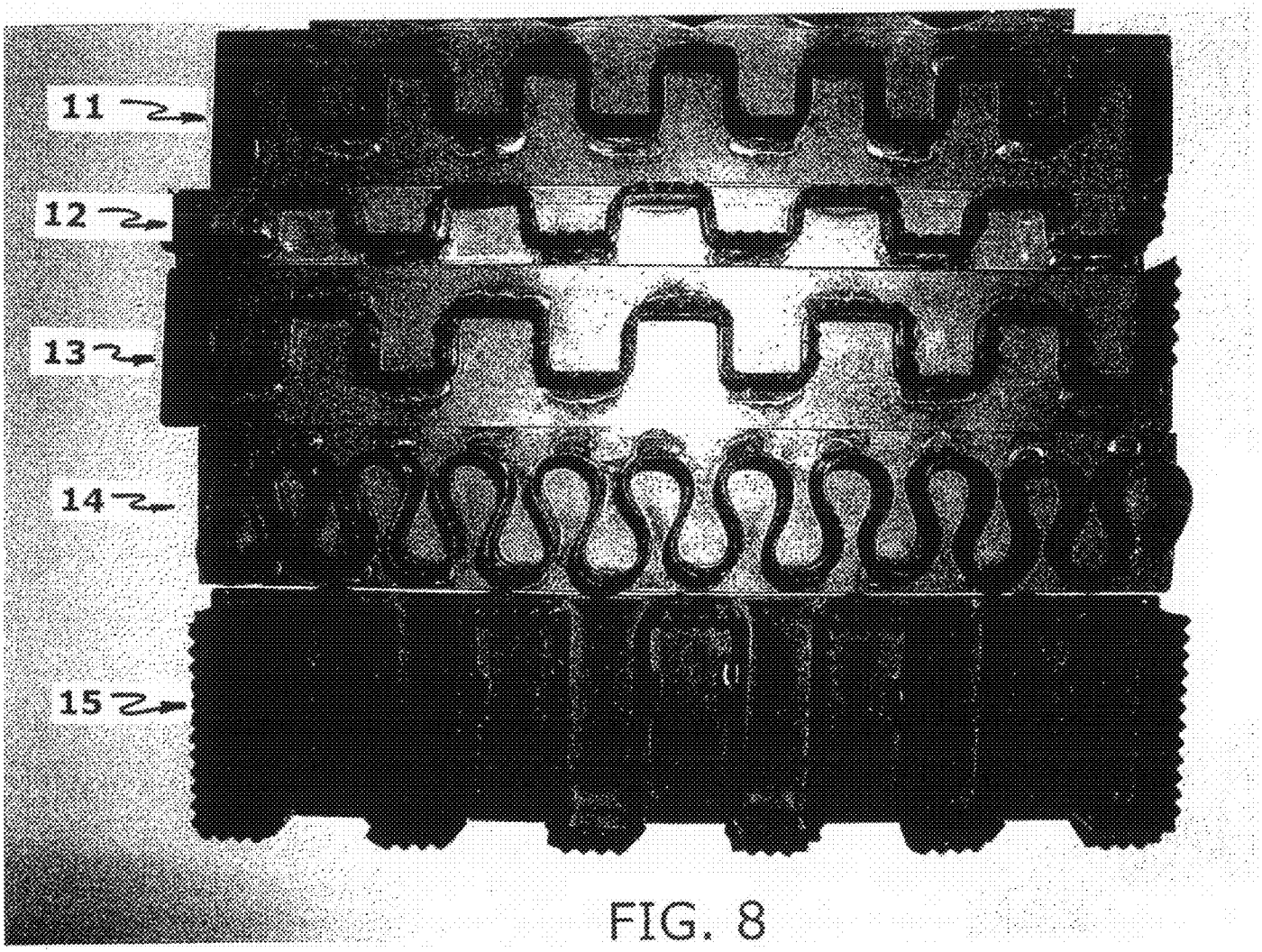
FIG. 8 illustrates a plurality of cutters that can be used to cut the projections, such as castellations, extending from each of the end regions of the belt of the invention.

Following the seam mark, the castellations are then cut in sections, using one of the cutters 11, 12, 13, 14, or 15, shown in FIG. 8. The cutters 11-15 are exemplary of various shapes that can be cut for the seam 6. For example, with reference to cutter 11, cutter 12 provides a seam having rectangular projections with a shallower MD-depth and a greater CD-width, cutter 13 providing a slightly greater width. Cutter 14 creates projections having an arcuate form. Cutter 15 creates projections having a greater MD-depth.

Once the projections/castellations 7*a*-7*c*, etc., 8*a*-8*d*, etc. are cut, the seaming pintles 10 and the tubular pintles 16 within which the seaming pintles 10 had been inserted, are also cut along their lengths, inasmuch as the cutter severs the entire thickness of the belt. At this time, the small sections of the tubular pintles and the seaming pintles are removed from the individual projections/castellations. Once that is done, the belt is ready for use, i.e., the belt is ready to be on-machine mounted. When the belt is mounted, thus manufactured, the seam is completed (i.e., re-made) by inserting either polyester or steel pintle wires, e.g., in the places where the seaming pintles and tubular pintles had been located. Each of the pintle wires thereby extend through and connect together the adjacent meshed projections. With reference to FIG. 2, each pintle wire extends, in succession, through castellations 8*a*, 7*a*, 8*b*, 7*b*, 8*c*, 7*c*, and 8*d*. As mentioned above, and with reference to FIG. 4, four such pintle wires are inserted in place of the four seaming wires 10.

The same technology described above in manufacturing a nonwoven fabric can be used with a woven fabric, whereby a small spiral insert is placed at the seam. The spiral insert should not exceed the caliper of the woven fabric.

If desired, a sealing compound can be added to the length of the non-linear seam thus created.

The particular embodiment of the invention that has been illustrated and described above provides for a castellated cut seam for any form of belt and, in particular, for a transfer belt for a papermaking machine, with a practical and effective method of on-machine joining, and one that results in minimal sheet marking.

Nevertheless, the foregoing description has been provided as being illustrative of the invention, but is not to be understood as limiting the invention to the particulars of the exemplary embodiments described herein. In this regard, it is to be understood that the particular words used herein are words of description and illustration, rather than words of limitation. Changes may be made, within the purview of the claims, as presently stated and as amended, without departing from the scope and spirit of the invention in its various aspects. Although the invention has been described herein with reference to particular embodiments, materials, and methods, the invention is not intended to be limited to the particulars disclosed herein; rather, the invention extends to all functionally equivalent structures, methods, and uses, such as are within the scope of the claims. Further, the invention illustratively disclosed herein may be practiced in the absence of any element which is not specifically disclosed herein.

What is claimed is:

1. An on-machine seamable industrial belt comprising:

a base structure comprising:

a plurality of machine-direction (MD) extending members; and a plurality of cross-machine-direction (CD) extending members interconnected with said plurality of MD-extending members;

a layer of impregnating material forming an encapsulated base structure;

said encapsulated base structure having first and second complementary inter-connectable end regions forming a non-linear seam;

each of said end regions comprising a plurality of CD-spaced-apart, MD-extending projections;

a plurality of parallel CD-extending tubular pathways within each of said projections, each of the tubular pathways adapted to receive a CD-extending member;

a plurality of said CD-extending members of the base structure being positioned along the belt beyond said end regions;

successive ones said CD-extending members within respective successive ones of said tubular pathways being spaced apart a distance equal to a spacing between successive pairs of said plurality of CD-extending members of the base structure positioned along the belt beyond said end regions.

2. An on-machine seamable industrial belt according to claim 1, further comprising:

a plurality of said CD-extending members received within said tubular pathways and extending from a first side to a second side of said base structure to form an endless belt.

3. An on-machine seamable industrial belt according to claim 2, wherein:

when installed on a machine and guided by at least a pair of rollers, said endless belt has a continuous flat outer surface extending throughout the machine direction between said pair of rollers, including through said non-linear seam.

4. An on-machine seamable industrial belt according to claim 1, wherein:

said base structure is a nonwoven structure.

5. An on-machine seamable industrial belt according to claim 4, wherein:

said nonwoven structure is a spiral link structure comprising a plurality of CD-extending rows of interdigitated spiral loops, each of said loops comprising a MD-extending member, said spiral link structure further comprising a series of CD-extending pintles.

6. An on-machine seamable industrial belt according to claim 1, wherein:

said first and second complementary end regions are interconnectable whereby said first and second end regions form a continuous non-linear seam from a first side to a second side of said encapsulated base structure.

7. An on-machine seamable industrial belt according to claim 1, wherein:

said plurality of CD-spaced-apart MD-extending projections of each of said first and second end regions comprise a plurality of castellations, said castellations of said first end region meshing with said castellations of said second end region at said non-linear seam.

8. An on-machine seamable industrial belt according to claim 7, further comprising:

a plurality of said CD-extending members received within said tubular pathways and extending from a first side to a second side of said base structure to form an endless belt.

9. An on-machine seamable industrial belt according to claim 1, wherein:

said projections have serrated peripheral edges, said serrated peripheral edges extending at least in the machine direction.

10. A method of constructing an on-machine seamable industrial belt that comprises a base structure comprising a plurality of machine-direction (MD) extending members and a plurality of cross-machine-direction (CD) extending members interconnected with said plurality of MD-extending members; a layer of impregnating material forming an encapsulated base structure; said encapsulated base structure having first and second complementary inter-connectable end regions forming a non-linear seam; each of said end regions comprising a plurality of CD-spaced-apart, MD-extending projections; and a plurality of parallel CD-extending tubular pathways within each of said projections, each of the tubular pathways adapted to receive a CD-extending member, said method comprising:

prior to adding the layer of impregnating material to the base structure, designating an area along a length of the base structure as an area for said non-linear CD-extending seam;

adding said layer of impregnated material to form said encapsulated base structure;

cutting said seam in said area.

11. A method of constructing an on-machine seamable industrial belt that comprises a base structure comprising a plurality of machine-direction (MD) extending members and a plurality of cross-machine-direction (CD) extending members interconnected with said plurality of MD-extending members; a layer of impregnating material forming an encapsulated base structure; said encapsulated base structure having first and second complementary inter-connectable end regions forming a non-linear seam; each of said end regions comprising a plurality of CD-spaced-apart, MD-extending projections; and a plurality of parallel CD-extending tubular pathways within each of said projections, each of the tubular pathways adapted to receive a CD-extending member, said method comprising:

prior to adding the layer of impregnating material to the base structure, designating an area along a length of the base structure as an area for said non-linear CD-extending seam;

inserting tubular pintles within said base structure from one side of the base structure to a second side;

inserting seaming pintles within respective ones of said tubular pintles;

adding said layer of impregnated material to form said encapsulated base structure;

cutting said seam in said area through a thickness of the encapsulated base structure, including cutting said tubular pintles and seaming pintles;

removing said tubular pintles and said seaming pintles from said encapsulated base structure, thereby leaving said plurality of tubular pathways within said projections.

12. A method according to claim 11, further comprising:

re-making said seam by adding CD-extending pintles within said tubular pathways from one side of the belt to a second side.

13. An on-machine seamable industrial belt comprising:

a spiral link structure comprising:

a plurality of rows of interdigitated spiral loops, each of said plurality of rows extending in a cross machine direction (CD), each of said loops comprising a machine-direction (MD) extending member; and a series of CD-extending parallel pintles, each of said pintles interconnecting a respective one of said plurality of rows of loops;

a layer of impregnating material forming an encapsulated spiral link structure;

said encapsulated spiral link structure having first and second complementary inter-connectable end regions forming a non-linear seam;

each of said end regions comprising a plurality of CD-spaced-apart, MD-extending projections;

each of said projections having a plurality of parallel CD-extending tubular pathways, each of the tubular pathways adapted to receive a pintle.

14. An on-machine seamable industrial belt according to claim 13, wherein:

said plurality of CD-spaced-apart MD-extending projections of each of said first and second end regions comprise a plurality of castellations, said castellations of said first end region meshing with said castellations of said second end region at said non-linear seam.

15. A method of manufacturing a belt that comprises a base structure comprising a plurality of machine-direction (MD) extending members and a plurality of cross-machine-direction CD extending members interconnected with said plurality of MD-extending members; a layer of impregnating material forming an encapsulated base structure; said encapsulated base structure having first and second complementary inter-connectable end regions forming a non-linear seam; each of said end regions comprising a plurality of CD-spaced-apart, MD-extending projections; and a plurality of parallel CD-extending tubular pathways within each of said projections, each of the tubular pathways adapted to receive a CD-extending member, said method comprising:

casting the base structure with said impregnating material, said casting comprising:

arranging the base structure to travel in a casting direction downwardly from top to bottom;

arranging a pair of casting belts on opposite sides of the base structure;

feeding said impregnating material at a feed point on one of said opposite sides of the base structure.

* * * * *